US007100511B2

(12) United States Patent
Meyer et al.

(10) Patent No.: US 7,100,511 B2
(45) Date of Patent: Sep. 5, 2006

(54) DUAL REDUNDANCY SYSTEM FOR ELECTRONIC DETONATORS

(75) Inventors: Erich Nicol Meyer, North West (ZA); Pieter Franciscus Zuidmeer, Cape Town (ZA)

(73) Assignee: SMI Technology Limited, Randburg (ZA)

( * ) Notice: Subject to any disclaimer, the term of this patent is extended or adjusted under 35 U.S.C. 154(b) by 0 days.

(21) Appl. No.: 10/275,482

(22) PCT Filed: May 18, 2001

(86) PCT No.: PCT/ZA01/00058

§ 371 (c)(1),
(2), (4) Date: Mar. 5, 2003

(87) PCT Pub. No.: WO01/92812

PCT Pub. Date: Dec. 6, 2001

(65) Prior Publication Data

US 2003/0192447 A1 Oct. 16, 2003

(30) Foreign Application Priority Data

Jun. 2, 2000 (ZA) ..... 2000/2769

(51) Int. Cl.
*F42B 3/12* (2006.01)
*F42C 11/06* (2006.01)
*F42D 1/05* (2006.01)

(52) U.S. Cl. ..... 102/206; 361/248

(58) Field of Classification Search ..... 102/706, 102/715, 202.5, 200, 202.14, 206, 217, 218, 102/322, 202.9, 202.12; 361/248, 249, 251
See application file for complete search history.

(56) References Cited

U.S. PATENT DOCUMENTS

| | | | | | |
|---|---|---|---|---|---|
| 2,998,776 | A | | 9/1961 | Morgan | |
| 3,227,083 | A | | 1/1966 | Hassler et al. | |
| 3,638,035 | A | * | 1/1972 | Murphy et al. | 307/141 |
| 3,695,178 | A | | 10/1972 | Betts | |
| 3,759,183 | A | * | 9/1973 | Apstein | 102/206 |
| 3,769,911 | A | * | 11/1973 | Folkins | 102/397 |
| 3,863,208 | A | * | 1/1975 | Balban | 280/735 |
| 3,967,556 | A | * | 7/1976 | Post et al. | 102/209 |
| 4,002,123 | A | * | 1/1977 | Fisher | 102/208 |
| 4,090,449 | A | * | 5/1978 | Stoltman et al. | 102/270 |
| 4,103,619 | A | * | 8/1978 | Fletcher et al. | 361/248 |
| 4,119,039 | A | * | 10/1978 | Wilkins et al. | 102/214 |
| 4,135,452 | A | * | 1/1979 | Kinsey et al. | 102/214 |
| 4,141,297 | A | * | 2/1979 | Sellwood | 102/206 |
| 4,192,554 | A | * | 3/1980 | Ricketts | 299/2 |
| 4,227,461 | A | * | 10/1980 | Beezley et al. | 102/218 |

(Continued)

FOREIGN PATENT DOCUMENTS

DE 3717149 A 11/1987

(Continued)

*Primary Examiner*—Michael J. Carone
*Assistant Examiner*—James S. Bergin
(74) *Attorney, Agent, or Firm*—Nixon & Vanderhye PC

(57) ABSTRACT

A detonator assembly (10) comprising a housing (12) disclosed and claimed. The assembly comprises an main circuit (11) comprising an electrically operable fuse (16) located in the housing. The assembly further comprises at least a first redundancy circuit (13) wherein at least one element of the main circuit is duplicated (18 for 16) also located in the housing. The invention also includes within its scope an initiation system (42) comprising at least one level of redundancy which may be in one or more or all of a blast controller (24), a harness (40) and detonator assemblies 10.1 to **10.*n*** forming part of the system.

15 Claims, 2 Drawing Sheets

Figure 1:
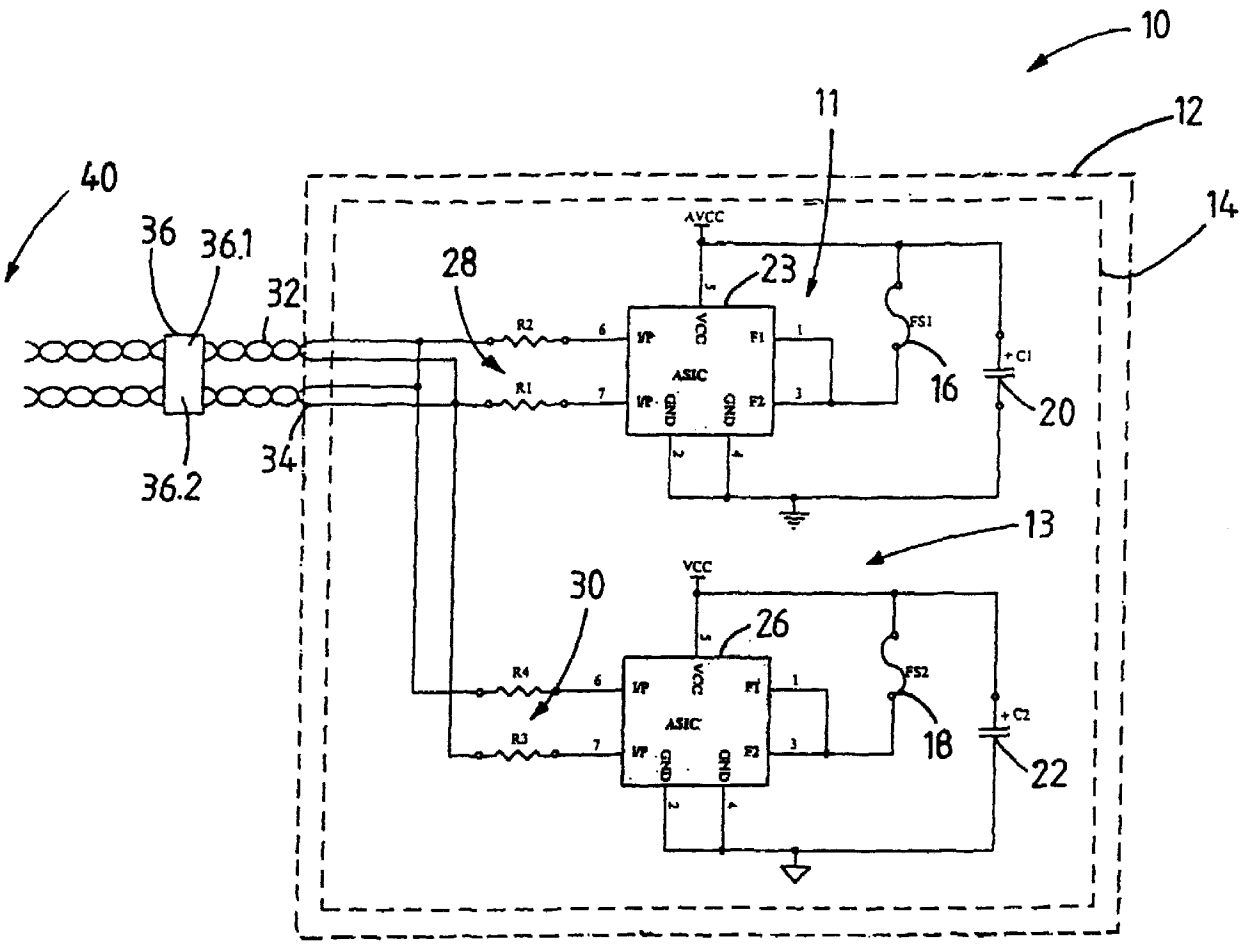

U.S. PATENT DOCUMENTS 4,246,845 A * 1/1981 Winton et al. ..... 102/206
4,625,205 A * 11/1986 Relis ..... 340/825.66
4,699,341 A * 10/1987 Ponticelli ..... 248/27.1
4,777,881 A * 10/1988 Candland et al. ..... 102/430
4,819,560 A * 4/1989 Patz et al. ..... 102/202.5
4,821,645 A * 4/1989 Reiss ..... 102/275.7
4,882,993 A * 11/1989 Schwartzman ..... 102/218
4,911,382 A * 3/1990 Aronne ..... 244/122 AE
4,953,464 A * 9/1990 Reiss ..... 102/312
4,969,525 A * 11/1990 George et al. ..... 166/297
5,007,661 A * 4/1991 Lenzen ..... 280/735
5,022,326 A * 6/1991 Silvia ..... 102/275.9
5,099,763 A * 3/1992 Coursen et al. ..... 102/313
5,181,737 A * 1/1993 Lenzen et al. ..... 280/732
5,392,860 A * 2/1995 Ross ..... 166/376
6,199,483 B1 * 3/2001 Barbiche ..... 102/201
6,298,924 B1 * 10/2001 Vaynshteyn et al. ..... 175/4.54
6,332,399 B1 * 12/2001 Laucht et al. ..... 102/206
6,672,215 B1 * 1/2004 Daoud ..... 102/202.14
6,718,881 B1 * 4/2004 Rauscher, Jr. ..... 102/217

FOREIGN PATENT DOCUMENTS

DE 3918408 A 12/1990
GB 2190730 A * 11/1987
WO 92/08932 A 5/1992

* cited by examiner

DUAL REDUNDANCY SYSTEM FOR ELECTRONIC DETONATORS

This application is the U.S. national phase of international application PCT/ZA01/00058 filed 18 May 2001, which designated the US.

TECHNICAL FIELD

THIS invention relates to detonators, more particularly electrical and electronic detonators, initiation systems comprising such detonators and to a method of manufacturing the detonator and/or the system.

BACKGROUND ART

Detonator assemblies comprising an electrical or an electronic detonator connected via lead wires to a harness are known in the art. In use, a plurality of such assemblies are connected via the harness to a blast controller and located in respective blast holes of a blast site. The blast controller is used to control the detonators and to cause them to detonate in a particular sequence and pattern, to cause a desired multi-shot blast pattern.

Due to certain reliability problems with the detonator assemblies, it is the practice in some countries to place in each blast hole a first detonator assembly as well as a second, parallel or back-up detonator assembly. It will be appreciated that the provision and connecting of a separate, parallel back-up detonator assembly not only take up unnecessary time, but are cumbersome and errors may occur in the connection of the back-up assembly.

OBJECT OF THE INVENTION

Accordingly, it is an object of the present invention to provide a detonator assembly, a initiation system and a method of manufacturing the detonator assembly and system with which the applicant believes the aforementioned disadvantages may at least be alleviated.

SUMMARY OF THE INVENTION

According to the invention there is provided a detonator comprising a housing; a main circuit comprising an electrically operable fuse located in the housing; and at least a first redundancy circuit wherein at least one element of the main circuit is duplicated, also located in the housing.

The detonator may be an electric detonator, alternatively an electronic detonator.

The main circuit may comprise the fuse, a charge storage device and a controller. The charge storage device may be a capacitor and the controller may be micro-processor based and may further comprise associated memory circuitry, delay time determining circuitry and data communications circuitry.

The redundancy circuit may be a full redundancy circuit comprising a fuse, a charge storage device and a local controller. In other embodiments, further levels of full or partial redundancy may be provided.

The main circuit and redundancy circuit may be provided on a single printed circuit board. The main circuit and redundancy circuit may be provided on one face of the board, in other embodiments they may be provided on both faces and in yet other embodiments the main circuit may be provided on the one face and the redundancy circuit may be provided on the other face. In yet other embodiments the main circuit may be provided on a first printed circuit board and the redundancy circuit may be provided on a second printed circuit board, both printed circuit boards being located in the housing.

Further included within the scope of the present invention is a detonator assembly comprising a detonator as hereinbefore defined; a connector and a connection cable extending between the connector and the detonator.

The connector and/or the connection cable may also comprise at least a first level of redundancy. For example, the connection cable may comprise a main conductor arrangement and a first redundancy conductor arrangement extending between the detonator and the connector. Similarly, the connector may comprise a main set of contacts and a first set of redundancy contacts both connected to the first conductor arrangement, or to respective ones of the conductor arrangements, or to both conductor arrangements.

Still further included within the scope of the present invention is a blast controller comprising a housing: a main circuit located in the housing and connectable to an output for communicating with and controlling detonators connected to the output; and a first redundancy circuit wherein at least one element of the main circuit is duplicated, also located in the housing and connectable to the output.

The first redundancy circuit may comprise a full duplication of all the elements of the main circuit, so that it is a full redundancy circuit. The main circuit and the first redundancy circuit may each comprise circuit status monitor means connected to a central controller, the central controller being operative in response to signals from the circuit status monitor means, to connect either the main circuit or the first redundancy circuit to the output of the blast controller.

Yet further included within the scope of the present invention is a initiation system comprising a blast controller as hereinbefore defined; and a plurality of detonator assemblies also as hereinbefore defined, the assemblies being connected to a harness connected to the output of the blast controller.

The harness may also comprise at least a first level of redundancy. The invention also includes within its scope a harness having at least a first level of redundancy.

Also included within the scope of the invention is a method of producing a component (such as a detonator, blast controller etc) of an electrically controllable detonator initiation system, the method comprising the steps of

- providing a housing for the component;
- providing a main circuit of the component in the housing; and
- providing a first redundancy circuit in the housing, the first redundancy circuit comprising at least one element of the main circuit duplicated in the redundancy circuit.

BRIEF DESCRIPTION OF THE ACCOMPANYING DIAGRAMS

Figure 2:
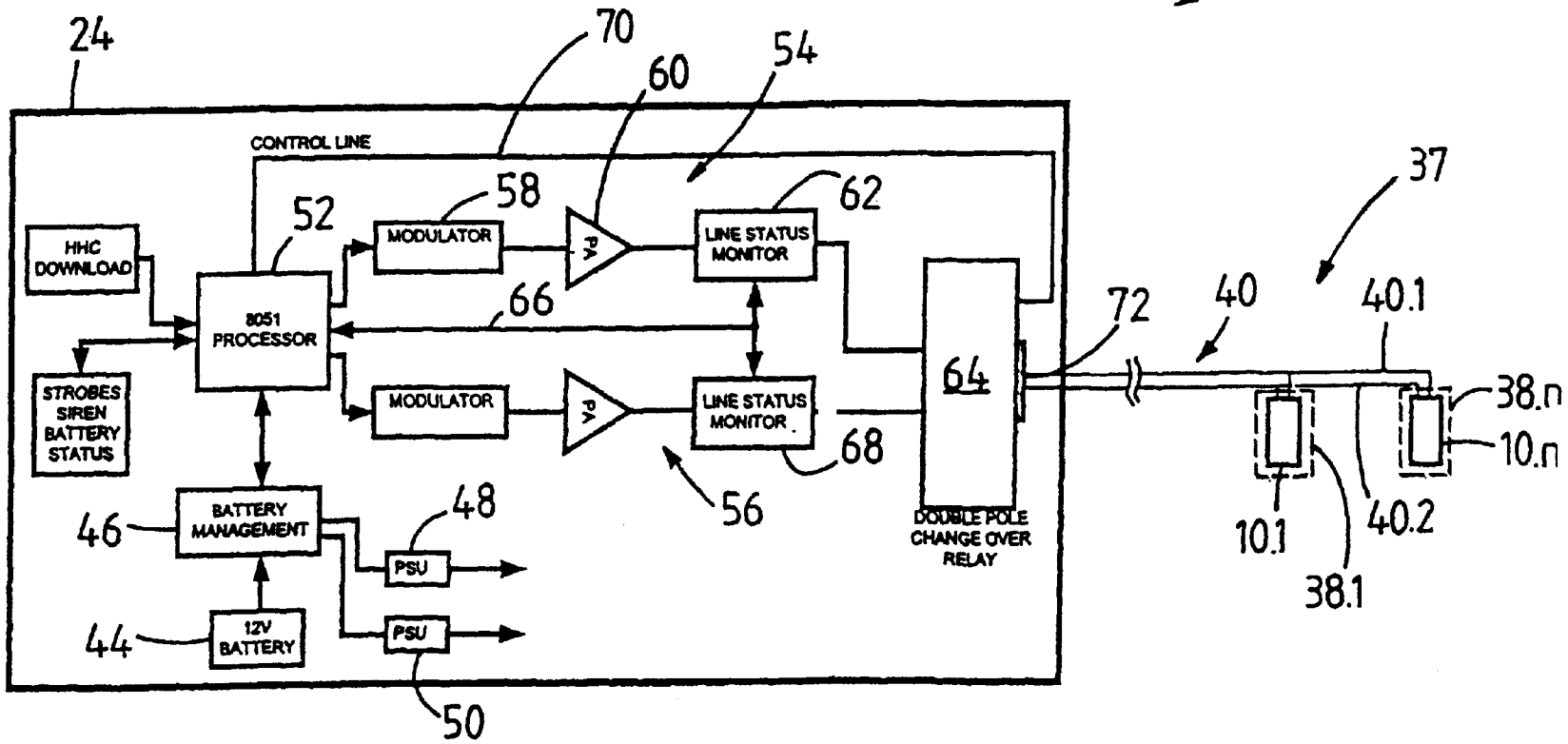

The invention will now further be described, by way of example only, with reference to the accompanying diagrams wherein:

FIG. 1 is a block diagram of an electronic detonator assembly according to the invention; and FIG. 2 is a block diagram of an initiation system including a blast controller, both according to the invention.

DESCRIPTION OF A PREFERRED EMBODIMENT OF THE INVENTION

A detonator assembly according to the invention is generally designated by the reference numeral 10 in FIG. 1.

The detonator assembly comprises a housing 12 for a printed circuit (PC) board 14. On the PC board there is provided a main circuit 11 comprising a detonator bridge or fuse 16. A first redundancy circuit 13 comprising a second bridge 18 is also provided on the board. The bridge 16 and bridge 18 may be provided on the same face of the PC board, alternatively on opposite faces thereof. Similarly, the circuit 11 and circuit 13 may be provided on the same face of the PC board, alternatively on opposite faces thereof.

The main circuit 11 comprises a charge storage capacitor 20. The capacitor 20 and bridge 16 are charged and controlled respectively in known manner by a controller embodied in a main application specific integrated circuit (ASIC) 23. The ASIC 23 comprises electronic circuitry including a microprocessor based controller (not shown), associated memory arrangements (not shown), digital delay time determining means (not shown) and digital circuitry (also not shown) enabling and facilitating digital data communications between the controller and an external device, such as a blast controller 24, shown in FIG. 2.

The capacitor 22 and bridge 18 of redundancy circuitry 13 are charged and controlled respectively by a similar and first redundancy ASIC 26.

Input resistors 28 and 30 for ASIC 23 and redundancy ASIC 26 respectively are also provided on the PC board 14.

In other embodiments the redundancy circuit 13 comprising bridge 18, capacitor 22, ASIC 26 and input resistors 30 may be provided on a second and separate PC board (not shown), but which is located in the same housing 12.

The input resistors 28 and 30 are connected via a main and first back-up lead in the form of twisted pairs 32 and 34 to a connector 36. In other embodiments protection arrangements (not shown) may also be provided between the ASIC's and conductors 32 and 34.

The connector 36 comprises a main set of contacts 36.1 for twisted pair 32 and a first set of redundancy contacts 36.2 for twisted pair 34.

The blast controller 24 is shown in FIG. 2. In use, it is positioned remote from the blast face 37 and blast holes 38.1 to **38.*n***.

In each hole, a detonator assembly 10 as hereinbefore described and comprising at least one level of partial or full redundancy circuitry as hereinbefore described is located in known manner. In FIG. 2, detonator assembly 10.1 for first hole 38.1 and detonator assembly **10.*n* for the $n^{th}$ hole 38.*n*** are shown.

The detonator arrangements 10.1 to **10.*n* are connected to the blast controller 24 by at least a first level of redundancy harness 40 comprising cables 40.1 and 40.2 and respective contacts 36.1 and 36.2** as hereinbefore described.

According to the invention, the blast controller 24 may also be provided with any desired level of redundancy to pitch the reliability of the initiation system 42 at a desired level. In FIG. 2, a blast controller 24 with a first level of redundancy is shown, merely as an example.

The blast controller 24 comprises a battery 44, battery management means 46, a main power supply unit 48 for the blast controller 24 and a back-up power supply unit 50 for the blast controller 24.

The blast controller 24 further comprises a micro-processor based controller 52 operable to control a main branch 54 and a first back-up or redundancy branch 56.

The main branch includes a modulator/demodulator 58 for data signals (preferably digital) to be transmitted to the detonator assemblies 10.1 to **10.*n* and to be received therefrom. A power amplifier 60 amplifies the relevant signals. A branch status monitor circuit 62 connected to the processor 52 monitors the status of the main branch 54. The main branch 54 and back-up branch are connected to a switching circuit 64, for example in the form of a double pole change over relay, to connect, under control of the controller 52 and depending on the status of the branches, the one branch 54 or the other branch 56 via output 72 to the harness 40**.

The other branch 56 is similar to the main branch 54 and a feed-back loop 66 is provided between branch status monitor circuits 62, 68 and the controller 52. The controller 52 controls the switching circuit 64 via line 70 in response to status signals received from status monitor circuits 62 and 68. Should there be a fault or failure in branch 54, the controller automatically causes switching circuit 64 to switch back-up branch 56 to be connected via the output to harness 40, to communicate with and control the detonator assemblies 10.1 to **10.*n***.

The invention provides a single detonator assembly 10 which has a first level or higher of full or partial redundancy. Furthermore, the blast controller 24 has parallel branches 54 and 56 one of which may automatically be elected by the controller, to provide back-up and hence improved reliability.

The invention also extends to a method of manufacturing detonator assemblies 10 and a blast controller 24 having at least a first level of full or partial redundancy as hereinbefore described. This means that at least essential parts of a main circuit is duplicated in a parallel back-up or redundancy circuit.

It will be appreciated that there are many variations in detail on the detonator assembly, harness, initiation system, blast controller and method of manufacture as herein described without departing from the scope and spirit of the appended claims.

The invention claimed is:

1. A detonator initiation system comprising:

a blast controller; and at least one electronic detonator which is connectable to the blast controller, the at least one detonator comprising:

a housing;

a main electronic circuit comprising an electrically operable fuse that is operated when the electronic detonator is to be fired, the main electronic circuit being located in the housing; and at least a first redundancy circuit comprising at least one of a duplicate of the fuse and a duplicate of at least another part of the main electronic circuit, the first redundancy circuit being at least a partial back up for the main electronic circuit for firing the detonator in the event that the main electronic circuit does not fire the detonator, the first redundancy circuit being located in the housing.

2. A detonator initiation system as claimed in claim 1 wherein the main electronic circuit further comprises a charge storage device, which is connectable to the fuse, and a local controller.

3. A detonator initiation system as claimed in claim 2 wherein the charge storage device comprises a capacitor and the controller is micro-processor based and further comprises associated memory circuitry and data communications circuitry.

4. A detonator initiation system as claimed in claim 2 wherein the first redundancy circuit comprises a full duplication of the main electronic circuit.

5. A detonator initiation system as claimed in claim 1 wherein the at least one detonator is connected to a harness by a connector and a cable extending between the connector and the detonator.

6. A detonator initiation system as claimed in claim 5 wherein the cable comprises a main conductor arrangement and a first redundancy conductor arrangement.

7. A detonator initiation system as claimed in claim 6 wherein the connector comprises a main set of contacts connected to the main conductor arrangement and a first set of redundancy contacts connected to the first redundancy conductor arrangement.

8. A detonator initiation system as claimed in claim 7 wherein the main and first redundancy conductor arrangements comprise first and second twisted pairs respectively, wherein the first twisted pair is connected at one end thereof to the main set of contacts and at another end thereof to the main circuit and the first redundancy circuit, and wherein the second twisted pair is connected at one end thereof to the first set of redundancy contacts and at another end thereof to the main circuit and the first redundancy circuit.

9. A detonator initiation system as claimed in claim 1 wherein the blast controller comprises a housing, a main blast controller circuit located in the housing and connectable to an output for communicating with and controlling the at least one detonator connected to the output, and a first redundancy blast controller circuit wherein at least part of the main blast controller circuit is duplicated, also located in the housing and connectable to the output.

10. A detonator initiation system as claimed in claim 9 wherein the main blast controller circuit and the first redundancy blast controller circuit each comprises circuit status monitor means connected to a central controller, the central controller being operative in response to signals from the circuit status monitor means, to connect either the main blast controller circuit or the first redundancy blast controller circuit to the output of the blast controller.

11. A detonator initiation system as claimed in claim 1 wherein a plurality of detonators are connected to the blast controller via a harness connected to the output of the blast controller.

12. A detonator initiation system as claimed in claim 11 wherein the harness comprises a main path for electronic signals and a first redundancy path for such signals.

13. A detonator initiation system as claimed in claim 12, wherein a main set of contacts of each detonator is connected to the main path and the first set of redundancy contacts is connected to the first redundancy path.

14. An electronic detonator comprising: a housing;

a main electronic circuit comprising an electrically operable fuse that is operated when the electronic detonator is to be fired, the main electronic circuit being located in the housing; and at least a first redundancy circuit comprising at least one of a duplicate of the fuse and a duplicate of at least another part of the main electronic circuit, the first redundancy circuit being at least a partial back-up for the main electronic circuit for firing the electronic detonator in the event that the main electronic circuit does not fire the detonator, the first redundancy circuit also being located in the housing.

15. A blast controller for a detonator initiation system, the blast controller comprising:

a first housing, a main blast controller circuit located in the first housing and connectable to an output of the blast controller to be in data communication with electronic detonators connected to the output; and a first redundancy blast controller circuit that is provided as at least a partial back-up for the main blast controller circuit, the first redundancy circuit comprising a duplicate of at least part of the main circuit, the first redundancy circuit also being located in the first housing and connectable to the outputs, each electronic detonator comprising:

a second housing;

a main electronic circuit comprising an electrically operable fuse that is operated when the electronic detonator is to be fired, the main electronic circuit being located in the second housing; and at least a first redundancy circuit comprising at least one of a duplicate of the fuse and a duplicate of at least another part of the main electronic circuit, the first redundancy circuit being at least a partial back up for the main electronic circuit for firing the detonator in the event that the main electronic circuit does not fire the detonator, the first redundancy circuit being located in the second housing.

* * * * *